US010040671B1

(12) United States Patent
Fenner

(10) Patent No.: US 10,040,671 B1
(45) Date of Patent: Aug. 7, 2018

(54) ENGINE BLOCK LIFT PLATE

(71) Applicant: James Fenner, Zionsville, IN (US)

(72) Inventor: James Fenner, Zionsville, IN (US)

( * ) Notice: Subject to any disclaimer, the term of this patent is extended or adjusted under 35 U.S.C. 154(b) by 0 days.

(21) Appl. No.: 15/879,501

(22) Filed: Jan. 25, 2018

(51) Int. Cl.
*B66C 1/66* (2006.01)
*B66C 1/10* (2006.01)

(52) U.S. Cl.
CPC ..... *B66C 1/107* (2013.01); *B66C 1/66* (2013.01)

(58) Field of Classification Search
CPC . B66C 1/107; B66C 1/66; B66C 1/666; B25J 1/04
USPC ..... 294/67.1, 67.5, 209, 215
See application file for complete search history.

(56) References Cited

U.S. PATENT DOCUMENTS 984,826 A * 2/1911 Ludlum
1,535,022 A * 4/1925 Jenkins ..... B66C 1/62 294/67.1
2,703,252 A * 3/1955 Blackwell ..... B66C 1/10 105/156
3,751,097 A * 8/1973 Jones ..... B66C 1/10 294/67.21
4,534,588 A * 8/1985 Markey ..... B66C 1/125 294/67.1
4,936,616 A * 6/1990 Williams ..... B66C 1/10 294/67.5
5,775,664 A * 7/1998 Martin ..... B61D 45/001 248/499
5,800,000 A * 9/1998 Shockley ..... B66C 1/107 294/67.5
5,823,588 A * 10/1998 Morghen ..... B66C 1/66 294/89
8,596,700 B2 * 12/2013 Alba ..... B66C 1/108 294/215
2006/0055188 A1 * 3/2006 Koch ..... B66C 1/108 294/215

FOREIGN PATENT DOCUMENTS

CN 201834657 5/2011
WO 2003078294 9/2003

* cited by examiner

*Primary Examiner* — Dean J Kramer
(74) *Attorney, Agent, or Firm* — C. John Brannon; Brannon Sowers & Cracraft PC

(57) ABSTRACT

A kit for facilitating the removal of an engine block from a vehicle by a single mechanic, including a connection plate, wherein the connection plate further includes at generally flat plate member having a first side and an oppositely disposed, generally parallel second side, a plurality of apertures formed through the generally flat plate member, a swivel connector operationally connected to the first side, and at least one sleeve member for receiving an elongated manipulation member operationally connected to the first side. The kit further includes a plurality of bolts for threadedly engaging bolt holes in an engine block and an elongated manipulation member for engaging the at least one sleeve member. wherein at least some of the apertures are positioned to match preexisting bolt holes in an engine block.

4 Claims, 5 Drawing Sheets

ENGINE BLOCK LIFT PLATE

TECHNICAL FIELD

This specification relates generally to the field of mechanical engineering and, more specifically, to plate for attachment to an engine block to facilitate removal and/or replacement of said engine block from an automobile by a lone workman.

BACKGROUND

Engine blocks are massive, and typically require two or more workmen to manipulate during removal from and/or replacement in a vehicle. Even with the aid of a hoist or the like, at least one person is required to attend to the motion of the dangling engine block while another attends to the engine connections. However, sometimes only one workman is available to remove or replace an engine block in a vehicle, and this lone workman must contend with the rotation and swaying of the massive engine block as it is suspended by chain from a hoist while simultaneously trying to remove or replace fasteners and connections to the vehicle, which may prove overwhelming and dangerous. Thus, there is a need for more efficient method and apparatus for facilitating the removal, manipulation, and replacement of an engine block by a lone mechanic.

The present novel technology addresses these needs.

BRIEF DESCRIPTION OF THE DRAWINGS

Like reference numbers and designations in the various drawings indicate like elements.

DETAILED DESCRIPTION

Before the present methods, implementations, and systems are disclosed and described, it is to be understood that this invention is not limited to specific synthetic methods, specific components, implementation, or to particular compositions, and as such may, of course, vary. It is also to be understood that the terminology used herein is for the purpose of describing particular implementations only and is not intended to be limiting.

As used in the specification and the claims, the singular forms "a," "an" and "the" include plural referents unless the context clearly dictates otherwise. Ranges may be expressed in ways including from "about" one particular value, and/or to "about" another particular value. When such a range is expressed, another implementation may include from the one particular value and/or to the other particular value. Similarly, when values are expressed as approximations, for example by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not. Similarly, "typical" or "typically" means that the subsequently described event or circumstance often, though may not always, occur and that the description includes instances where said event or circumstance occurs and instances where it does not.

The details of one or more embodiments of the subject matter described in this specification are set forth in the accompanying drawings and the description below. Other features, aspects, and advantages of the subject matter will become apparent from the description, the drawings, and the claims.

In general, the present novel technology relates to a lift plate for attachment to an engine block that connects to the intake manifold. The lift plate includes a swiveling eye hook or the like for engaging the hook at the end of a hoist chain, wherein the swivel function allows the chain to rotate and remove any 'twist' without necessarily rotating the engine block. The lift plate also includes three cylindrical sleeves extending therefrom, positioned towards the front, left side and right side of the car when engaged to the engine block. The sleeves are sized to accept lengths of pipe inserted thereinto to allow an individual working alone sufficient leverage to pivot, turn, sway and move the engine into place when removing and replacing the same onto it mounts.

Figure 1:
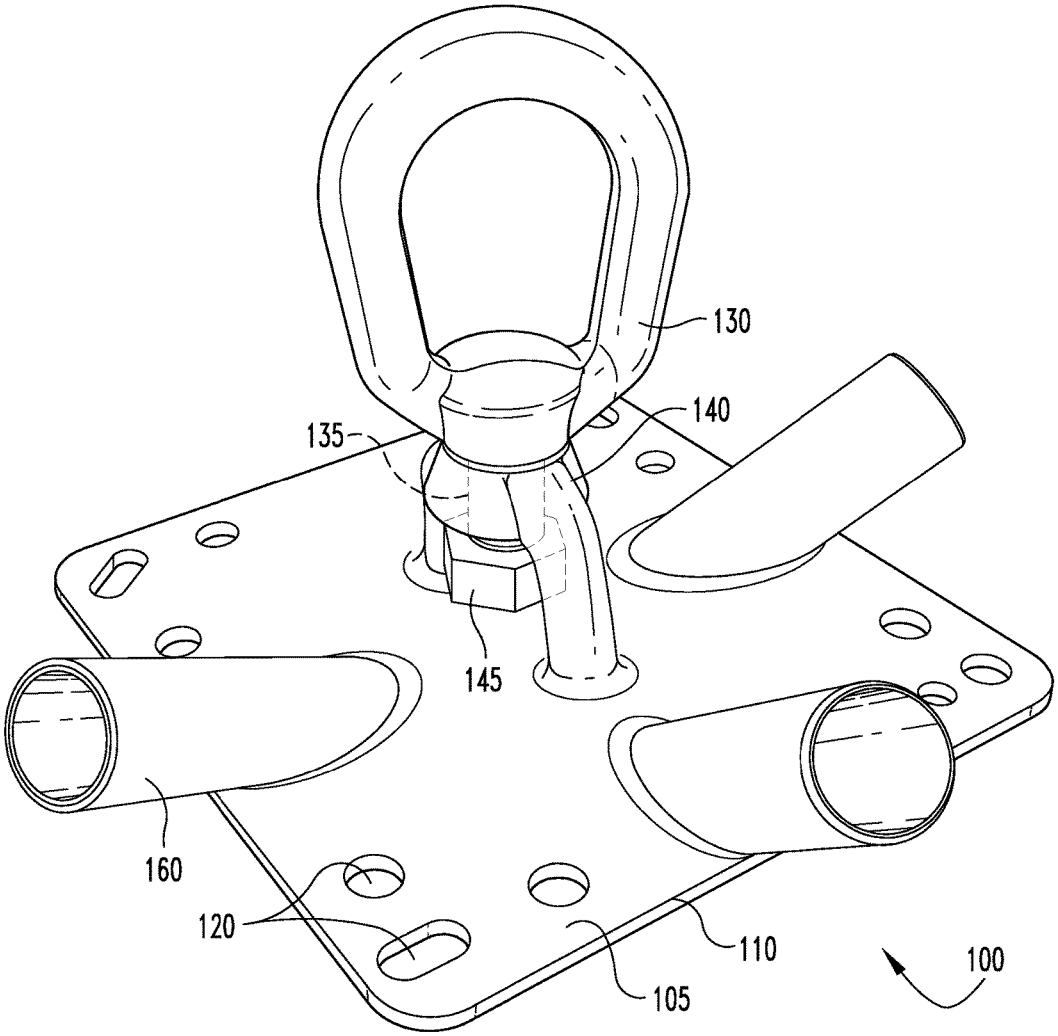
FIG. 1 depicts a first top perspective view of a first embodiment lift plate according to the present novel technology.
Figure 2:
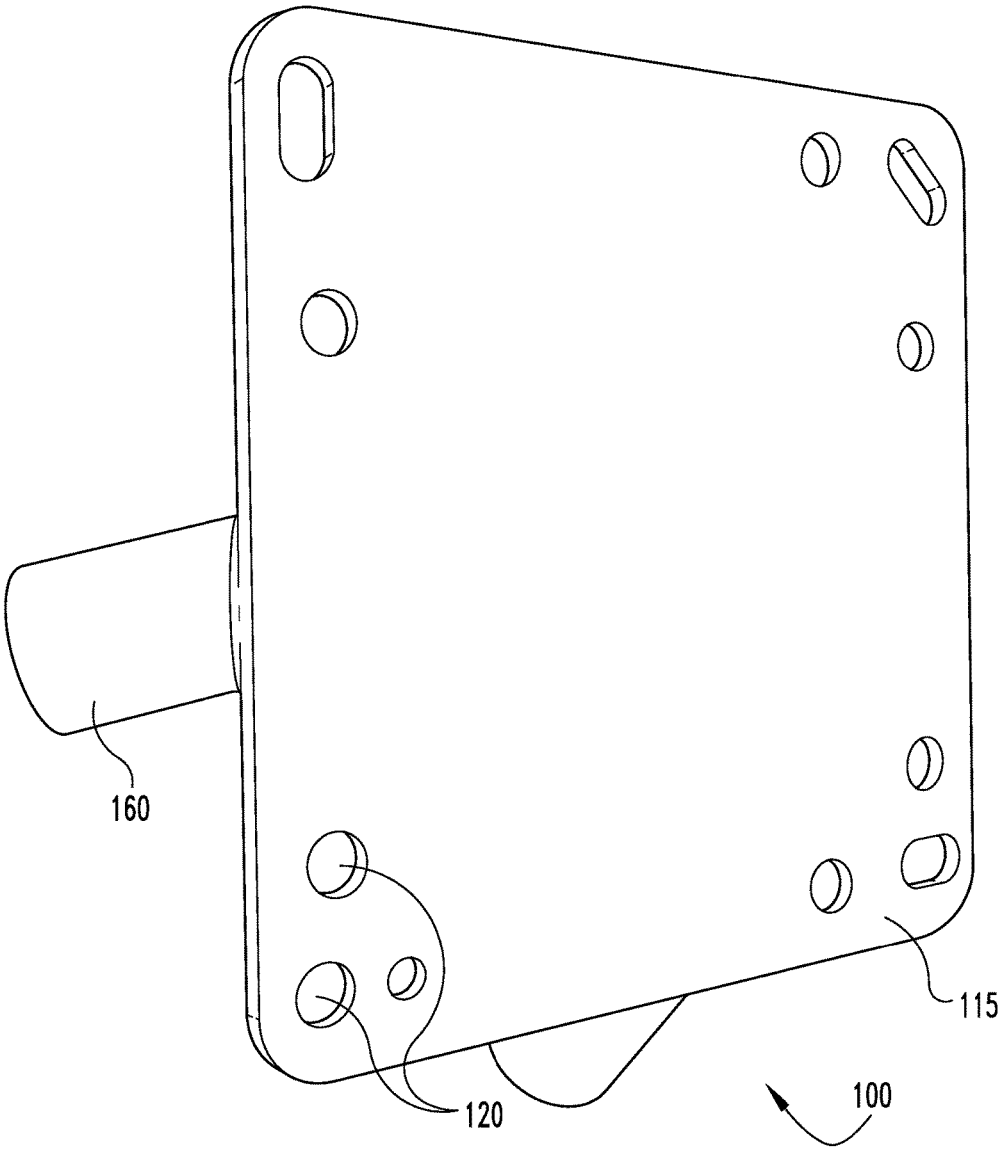
FIG. 2 depicts a first bottom perspective view of the lift plate of FIG. 1.
Figure 3:
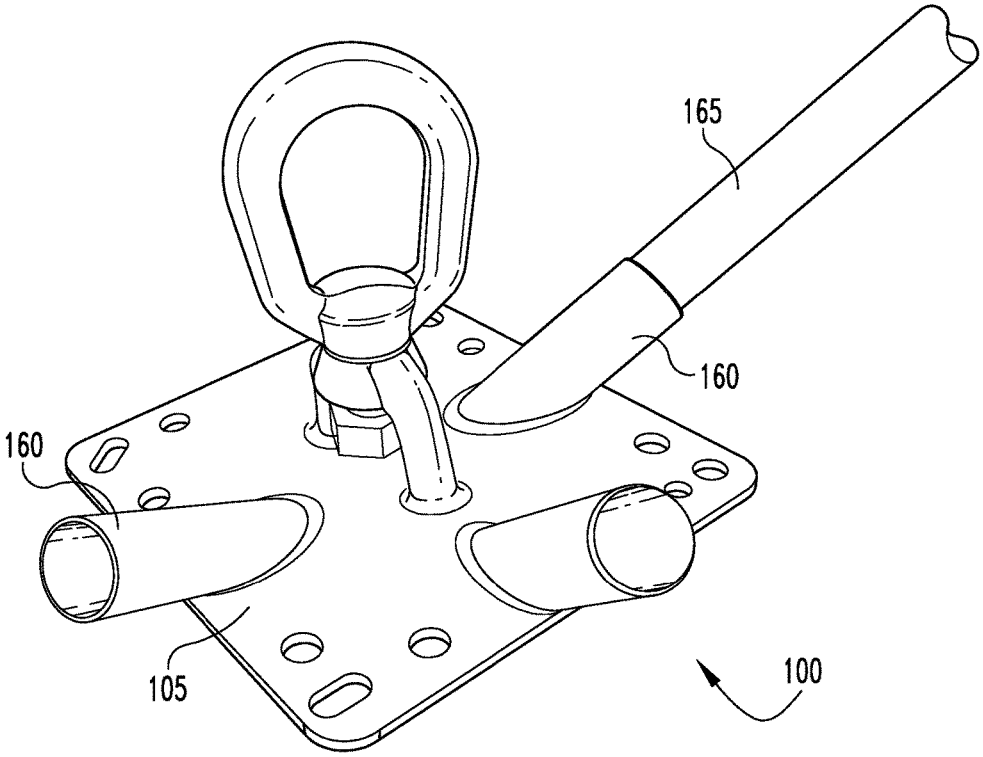
FIG. 3 depicts a second top perspective view of the lift plate of FIG. 1 with a manipulation rod engaged thereto.
Figure 4:
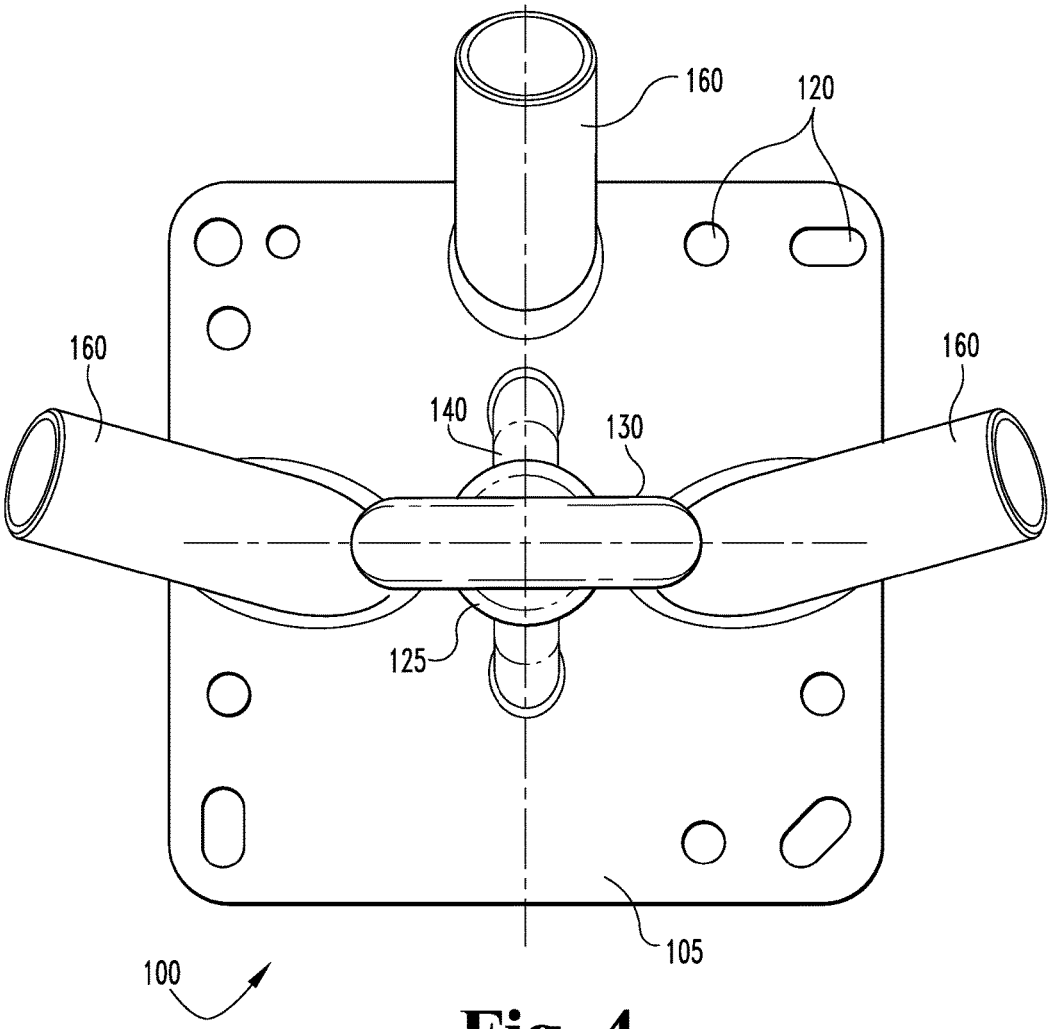
FIG. 4 depicts a top view of the lift plate of FIG. 1.
Figure 5:
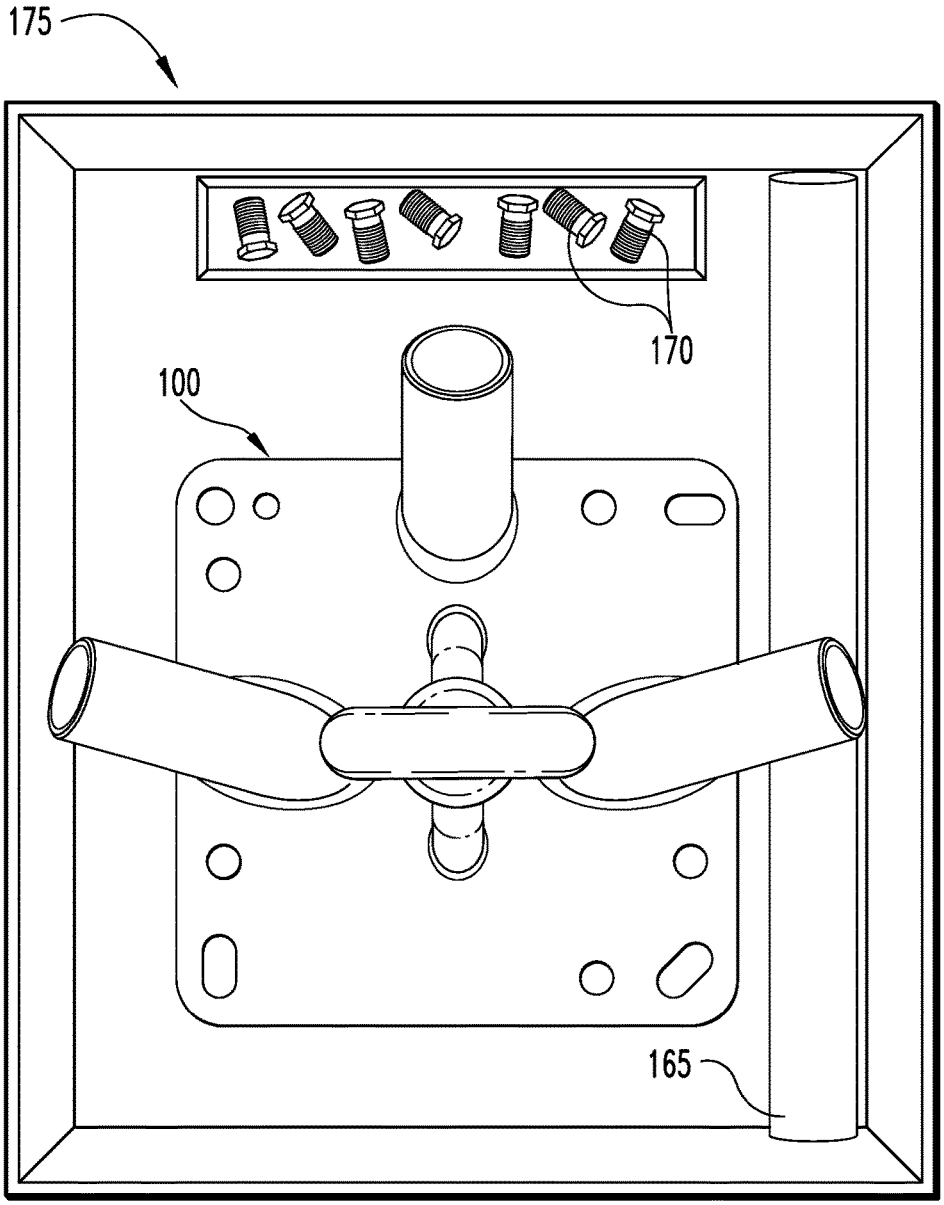
FIG. 5 depicts a kit including the lift plate of FIG. 1, the manipulation rod of FIG. 3, and a plurality of bolts.

FIGS. 1-5 depict various perspectives and embodiments associated with the instant novel lift plate system 100, which typically may include structural base plate member(s) 105; swivel connector(s) 125; rod receiving member(s) 160; and/or manipulator rod(s) 165. Specifically, FIGS. 1-4 depict perspective, top, and bottom views of the present novel engine block lift system 100, while FIG. 5 collects the various elements in kit form.

Typically, engine block lift plate system 100 includes a lift plate member 105 defining parallel first and second oppositely disposed surfaces 110, 115. More typically, first surface 105 may be considered the top or hoist-engaging surface, while oppositely disposed second surface 115 may be considered the bottom or engine block-engaging surface. The plate member 105 is typically relatively thin, insofar as the distance between surfaces 110, 115 or 'depth' is substantially less than the orthogonal length and width dimensions extending within the planes defined by the respective typically flat surfaces 110, 115.

Apertures 120 are formed through the lift plate member 105, typically positioned at or near the corners, for engaging an engine block via bolts inserted therethrough. The apertures define predetermined patterns matching those of threaded, preexisting aperture patterns in typical engine block designs. Bolts may be extended through the apertures 120 to threadedly engage an engine block, securing the plate 105 to the engine block. Apertures 120 may optionally be threaded.

A swivel connector 125 is operationally connected to the first side 110. In one embodiment, the swivel connector 125 typically includes a metal loop 130 from which extends an at least partially threaded metal cylinder 135. An aperture receiving member 140 is operationally connected (such as by welding) to the first surface, through which the cylinder portion may be extended and secured by engaging a threaded nut 145 thereto.

One or more hollow rod receiving members (also referred to as sleeves and/or tubes) 160 are operationally connected to and extend away from the first surface 110. The sleeves

160 typically define a 45-degree angle with the surface 110, although the sleeves 160 may be oriented at any convenient angle. In one embodiment, three sleeves 160 are connected to the surface, with each sleeve 160 oriented toward a different edge of the generally square member 105. In other embodiments, one, two, four, or other numbers of sleeve members 160 may be operationally engaged with the first surface 110.

Sleeves 160 are sized to loosely accept a manipulation rod 165. Manipulation rod 165 is typically about one meter in length and is sized to loosely engage the inner diameter of a sleeve 160 when engaged therewith or otherwise inserted thereinto.

Tubes 160 and rod 165 are typically cylindrical, with the sleeves 160 defining a circular opening for receiving the circular cross-section of the rod 165. However, the receiving members 160 and manipulation rods 165 may have any convenient cross-sectional shape so long as the receiving member 160 is sized and shaped to engage the rod member 165.

In operation, the lift plate 105 is lockingly engaged to an engine block, such as positioned in or resting in a vehicle, by positioning the plate 105 against an engine block with at least some of the apertures 120 aligned with threaded bolt holes in the engine block, and then inserting fasteners, such as bolts, through apertures 120 to threadedly engage the engine block bolt holes. An elongated flexible connection member, such as a chain, extending from a hoist or like lifting engine is engaged to the swivel connector 125 by engaging a hook extending from the chain with the metal loop 130. The engine block is otherwise disengaged from the vehicle, and the lifting engine is engaged to urge the engine block in a direction against the pull of gravity (upwardly) out of the vehicle. Typically, the intake manifolds is in place and secured prior to removal of the engine block from the vehicle. Any twist in the chain is accommodated and dissipated by the swivel connector 125 freely turning relative the plate member 105.

One or more manipulation rods 165 are engaged via sleeve(s) 160 with the lift plate 105, and the engine block may be moved or repositioned via application of urging forces on the manipulation rod(s) 165.

This process may be reversed to reinsert the engine block into the vehicle. After operating on the engine block, such as to effect repairs, the engine block may be repositioned via the manipulation rod to orient the engine block and by energizing the hoist to move the engine block in a direction congruent with gravitational acceleration. The engine block is then replaced in the vehicle and reengaged thereto, after which the plate member 105 is disengaged from the engine block.

Alternately, the engine block removed from the vehicle may be discarded, the hoist disengaged from the plate member 105, and the plate member 105 disengaged from the engine block. The plate member 105 may then be engaged with a replacement engine block, the hoist energized to move the replacement block in a direction opposite gravitational acceleration, and the manipulation rod urged to orient the engine block as desired. The hoist may then be energized to move the engine block in a direction congruent with gravitational acceleration while the manipulation rod is urged to position the replacement engine block for engagement with the vehicle. Once in place, the replacement engine block is operationally connected to the vehicle, the hoist disengaged from the plate member 105, and the plate member 105 disengaged from the replacement engine block.

While the various component parts 105, 125, 160, 165 are typically made of steel, one or more parts 105, 125, 160, 165 may be made partially or completely of any other convenient structural material, such as such as iron, aluminum, structural metal and/or alloys, plastic, ceramics, cermets, composites, combinations thereof, or other convenient structural materials, and/or the like.

The component parts, along with a plurality of fasteners, such as bolts 170, may be provided as a kit 175.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A method for removal of an engine block by a lone worker, comprising:

operationally connecting a plate member to an engine block;

extending an elongated flexible connection member from a hoist;

operationally connecting the elongated flexible connection member to the plate member;

engaging an elongated manipulation rod to the plate member;

disengaging the engine block from a vehicle;

energizing the hoist to urge the engine block to move against gravitational acceleration; and applying urging force to the engine block through movement of the elongated manipulation rod;

wherein the flexible member is free to rotate relative the plate member.

2. The method of claim 1, further comprising the steps of:

repairing the engine block;

moving the manipulation rod to orient the engine block;

energizing the hoist to move the engine block in a direction congruent with gravitational acceleration;

replacing the engine block in the vehicle; and reengaging the engine block with the vehicle.

3. The method of claim 1, further comprising the steps of:

discarding the engine block;

disengaging the hoist from the plate member;

disengaging the plate member from the engine block;

engaging the plate member to a replacement block;

energizing the hoist to move the replacement block in a direction opposite gravitational acceleration;

moving the manipulation rod to orient the replacement block;

energizing the hoist to move the replacement block in a direction congruent with gravitational acceleration;

positioning the replacement block in the vehicle;

disengaging the hoist from the plate member;

disengaging the plate member from the replacement block; and connecting the replacement block to the vehicle.

4. An engine block removal assembly, comprising:

a generally flat plate member having a first side and an oppositely disposed, generally parallel second side;

a plurality of apertures formed through the generally flat plate member;

a swivel connector operationally connected to the first side;

at least one sleeve member for receiving an elongated manipulation member operationally connected to the first side;

wherein at least some of the apertures are positioned to match preexisting bolt holes in an engine block;

wherein three sleeve members are operationally connected to the first side;

wherein first and second sleeve members extend in opposite directions; and wherein third sleeve member extends perpendicular to first and second sleeve members.

* * * * *